US010030434B1

(12) United States Patent
Plummer

(10) Patent No.: US 10,030,434 B1
(45) **Date of Patent: *Jul. 24, 2018**

(54) DOOR ASSEMBLY WITH DUAL SUPPORT CONNECTOR ASSEMBLY

(71) Applicant: John B. Plummer, Houston, TX (US)

(72) Inventor: John B. Plummer, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/713,292

(22) Filed: Sep. 22, 2017

(51) Int. Cl.

| | |
|---|---|
| ***E06B 3/58*** | (2006.01) |
| ***E06B 3/62*** | (2006.01) |
| ***E06B 3/64*** | (2006.01) |
| ***E06B 3/54*** | (2006.01) |

(52) U.S. Cl.
CPC ..... *E06B 3/5892* (2013.01); *E06B 3/5481* (2013.01); *E06B 3/62* (2013.01); *E06B 3/645* (2013.01); *E06B 2003/622* (2013.01); *E06B 2003/6244* (2013.01)

(58) Field of Classification Search
CPC ..... E06B 3/5892; E06B 3/62; E06B 3/5481; E06B 3/645; E06B 2003/622; E06B 2003/6244
See application file for complete search history.

(56) References Cited

U.S. PATENT DOCUMENTS

| | | | | |
|---|---|---|---|---|
| 3,760,543 | A * | 9/1973 | McAllister | E06B 3/5892 52/204.591 |
| 4,930,276 | A * | 6/1990 | Bawa | E06B 5/162 52/208 |
| 8,359,796 | B1 * | 1/2013 | Plummer | E06B 3/5892 52/204.61 |
| 8,434,284 | B1 * | 5/2013 | Plummer | E06B 3/5892 52/745.16 |
| 9,562,389 | B2 * | 2/2017 | Badger | E06B 3/5892 |
| 2003/0066256 | A1 * | 4/2003 | DeBlock | B32B 17/10 52/208 |
| 2004/0226233 | A1 * | 11/2004 | LaSee | E06B 3/5892 52/204.5 |
| 2007/0193140 | A1 * | 8/2007 | Carnick | E06B 3/5892 52/208 |
| 2008/0209826 | A1 * | 9/2008 | Hodges | E06B 3/5892 52/204.7 |
| 2015/0360445 | A1 * | 12/2015 | Cai | B32B 17/062 428/172 |

FOREIGN PATENT DOCUMENTS

| | | |
|---|---|---|
| GB | 2463267 B | 9/2012 |

* cited by examiner

*Primary Examiner* — Jeanette E Chapman
(74) *Attorney, Agent, or Firm* — Buskop Law Group, P.C.; Wendy Buskop

(57) ABSTRACT

A door assembly with the dual support connector has a door panel, a glass pane, a dual support connector assembly, a fixed sealing frame 18 for engaging the dual support connector assembly, a seal-less removable frame for attaching to the attachment (dual support connector assembly) on an opposite side of the fixed sealing frame 18, and a fastener engaging the dual support connector assembly to the fixed sealing frame. The dual support connector assembly has a clip body, a door flange extending from the clip body, a glass flange extending from the clip body in parallel with the door flange.

12 Claims, 7 Drawing Sheets

DOOR ASSEMBLY WITH DUAL SUPPORT CONNECTOR ASSEMBLY

CROSS REFERENCE TO RELATED APPLICATIONS

The present application claims a priority to U.S. Provisional Patent Application Ser. No. 62/477,077 filed on Mar. 27, 2017, for "Door Assembly with Dual Support Connector Assembly" and U.S. Provisional Patent Application Ser. No. 62/477,258 filed on Mar. 27, 2017, for "Carved High Strength Door." These references are hereby incorporated in their entirety.

FIELD

The present embodiment generally relates to door assembly with the dual support connector.

BACKGROUND

A need exists for door frame that allows a door to be easily removable.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present invention relates to an improved door assembly with a dual support connector assembly that does not require corner clips.

The door assembly with the dual support connector for door without corner clips has a door panel, and a glass pane.

A dual support connector assembly is positioned between the door and glass pane. The dual support connector assembly can include a clip body, a door flange extending from the clip body, a glass flange extending from the clip body in parallel with the door flange.

In embodiments, the door assembly with the dual support connector for door without corner clips includes a fixed sealing frame for engaging the dual support connector assembly.

A seal-less removable frame 16 for attaching to the dual support connector assembly on an opposite side of the fixed sealing frame.

In embodiments, the door assembly with the dual support connector includes a fastener for engaging the dual support connector assembly to the fixed sealing frame.

The embodiments provide secure connection, which prevents a door or glass pane from breaking during severe weather, such as a hurricane.

The embodiments, allow the glass panel to be easily removable for cleaning purposes.

Figure 1:
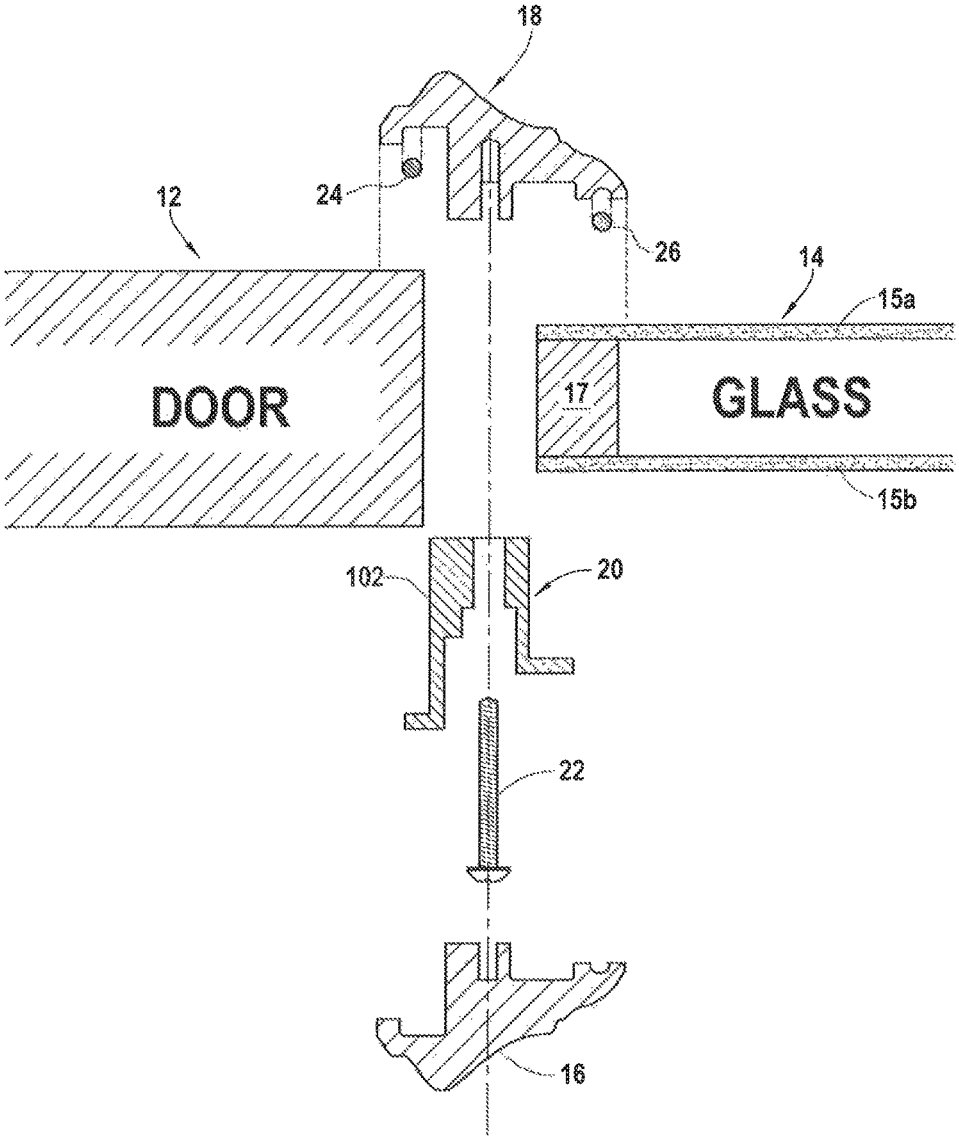
FIG. 1 depicts an exploded view of a door assembly with the dual support connector according to one or more embodiments.

Now turning to the Figures, FIG. 1 an exploded view of a door assembly with the dual support connector according to one or more embodiments.

The door assembly with the dual support connector has a door panel 12 and a glass panel 14.

In embodiments, a dual support connector assembly 20 is positioned between the door panel 12 and glass panel 14.

The door assembly with the dual support connector includes a fixed sealing frame 18. The fixed sealing frame engages the dual support connector assembly 20.

In embodiments, the door assembly with the dual support connector has a seal-less removable frame 16. The seal-less removable frame 16 attaches to the dual support connector assembly 20 on an opposite side of the door panel 12 and glass panel 14 from the fixed sealing frame 18.

A fastener 22 engages the dual support connector assembly 20 to the fixed sealing frame 18.

The door assembly with the dual support connector has a first seal 24 between the door panel 12 and the fixed sealing frame 18.

The door assembly with the dual support connector has a second seal 26 between the glass panel 14 and the fixed sealing frame 18.

In embodiments, the door assembly with dual support connector 20 has a plurality of compression brads 222*a*-222*d*. Each compression brad penetrates the seal-less removable frame 16 and clip body 102 at an angle between 10 degrees and 90 degrees in a spaced apart relationship.

Figure 2:
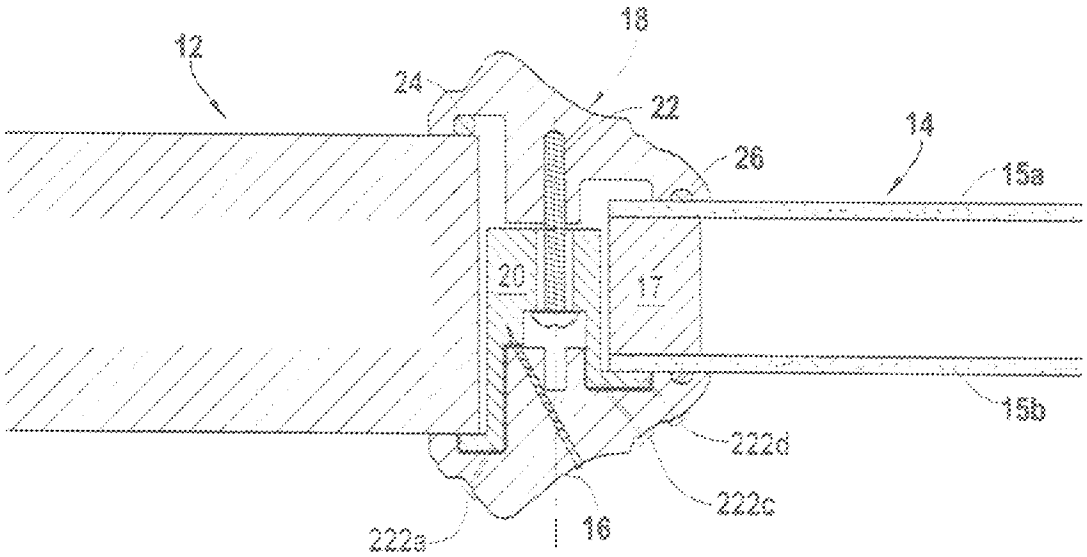
FIG. 2 depicts an assembled view of the elements of a door assembly with the dual support connector according to one or more embodiments.

FIG. 2 depicts an assembled view of the elements of a door assembly with the dual support connector according to one or more embodiments.

The door assembly with the dual support connector has a door panel 12 and a glass panel 14 attached to the fixed sealing frame 18 engaging the door panel and glass panel.

In embodiments, the door assembly with the dual support connector 20 has a seal-less removable frame 16. The seal-less removable frame 16 attaches to the dual support connector assembly 20 on an opposite side of the door panel 12 and glass panel 14 from the fixed sealing frame 18.

The glass panel can have a plurality of glass panes 15*a* and 15*b* separated by a spacer/sealant 17.

The fixed sealing frame 18 is engaged with the dual support connector assembly 20 via fastener 22. The seal-less removable frame 16 has brads 222*a*-222*c* applying compression to the frame for additional seal pressure.

In embodiments, the seal-less removable frame 16 is attached to the dual support connector assembly 20 on an opposite side of the door panel 12 and glass panel 14 from the fixed sealing frame 18.

The fixed sealing frame 18 is engaged with the dual support connector assembly 20 via a fastener 22.

Figure 3A:
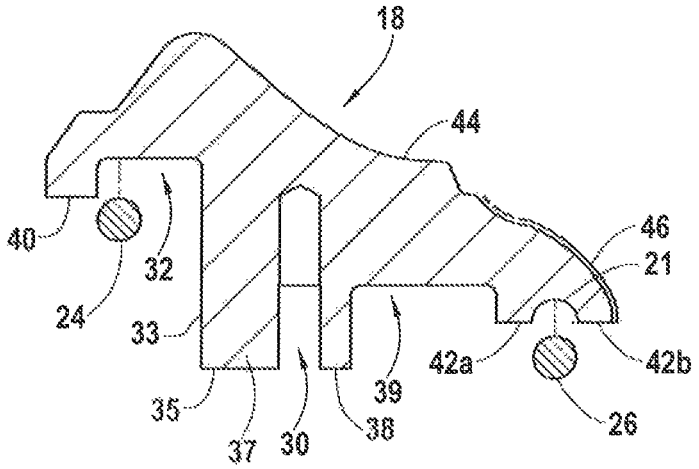
FIG. 3A depicts cross sectional view of the fixed sealing frame according one or more embodiments.

FIG. 3A depicts cross sectional view of the fixed sealing frame 18 according one or more embodiments.

The fixed sealing frame 18 includes a fixed sealing frame profile 44. The fixed sealing frame profile 44 is covered with a coating layer 46.

A door contact surface 40 extends from the fixed sealing frame profile 44.

The fixed sealing frame 18 includes a side flex and sealing gap surface 33. The side flex and sealing gap surface 33 extends from the door contact surface 40.

An upper flex and sealing gap 32 is formed between the door contact surface 40 and the side flex and sealing gap surface 33.

In embodiments, a lower flex and sealing gap surface 35 extends from the side flex and sealing gap surface 33 to form a first channel engagement member 37.

A second channel engagement member 38 is formed in parallel to the first channel engagement member 37 creating a first alignment cavity 30.

A flex gap 39 is formed between the second channel engagement member 38 and a first glass contact surface 42*a*.

In embodiments, a second glass contact surface 42*b* formed in parallel to the first glass contact surface 42*a* containing a first seal 24.

A second seal 26 is located between the door contact surface 40 and the side flex and sealing gap surface 33.

In embodiments a texture, a smooth surface or a woodgrain surface is formed on the fixed sealing frame profile 44.

In embodiments, a shape for the fixed sealing frame profile 44 is selected from the group consisting of a rectangle, a half round, or a decorative molding shape.

The fixed sealing frame profile 44 can have a coating layer 46. The coating layer 46 can consists of a stain, a paint, a sealant, or a primer coat.

Figure 3B:
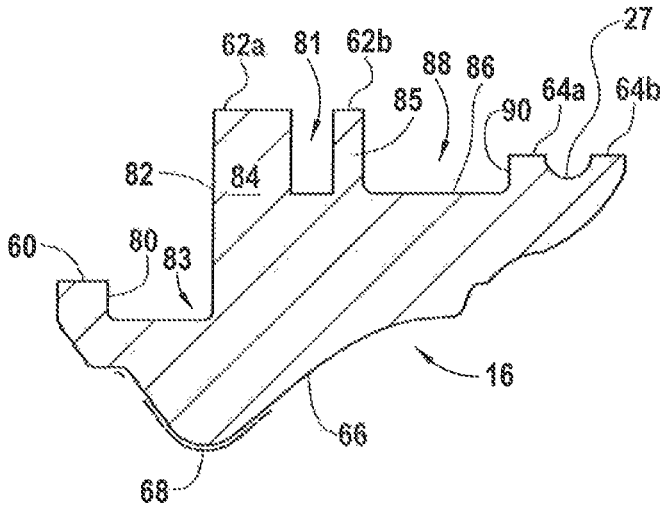
FIG. 3B depicts cross sectional view of the seal-less removable frame 16 according to one or more embodiments.

FIG. 3B depicts cross sectional view of the seal-less removable frame 16 according to one or more embodiments.

The seal-less removable frame 16 includes a seal-less removable frame profile 66 with a paint layer 68.

In embodiments, the seal-less removable frame 16 includes a door contact surface 60. The door contact surface 60 extends from the seal-less removable frame profile 66.

A first side gap surface 80 extends from the door contact surface 60.

A second side gap surface 82 extends from the first side gap surface 80 to form a rigid gap 83.

In embodiments, the seal-less removable frame 16 includes first alignment channel member 84.

A first clip surface 62*a* is formed on the first alignment channel member 84.

In embodiments, the seal-less removable frame 16 includes a second alignment channel member 85.

A second clip surface 62*b* is formed on the second alignment channel member 85 in parallel with the first clip surface 62*a*.

In embodiments, the seal-less removable frame 16 includes a second alignment cavity 81 formed between the first alignment channel member 84 and second alignment channel member 85.

The seal-less removable frame 16 includes a third side gap surface 86 extending from the second clip surface 62*b*.

A rigid gap 88 is formed between the second alignment channel member 85 and a fourth side gap surface 90.

In embodiments, the seal-less removable frame 16 includes a first glass contact surface 64*a*.

A second glass contact surface 64*b* is formed in parallel to the first glass contact surface 64*a* connecting to the seal-less removable frame profile 66.

In embodiments, a textured surface, a smooth surface or a woodgrain surface can be formed on the seal-less removable frame profile 66.

In embodiments, a shape for the seal-less removable frame profile 66 can be selected from the group consisting of a rectangle, a half round, or a decorative molding shape.

The seal-less removable profile can have a coating layer 68. The coating layer 68 can consists of a stain, a paint, a sealant, or a primer coat.

Figure 4:
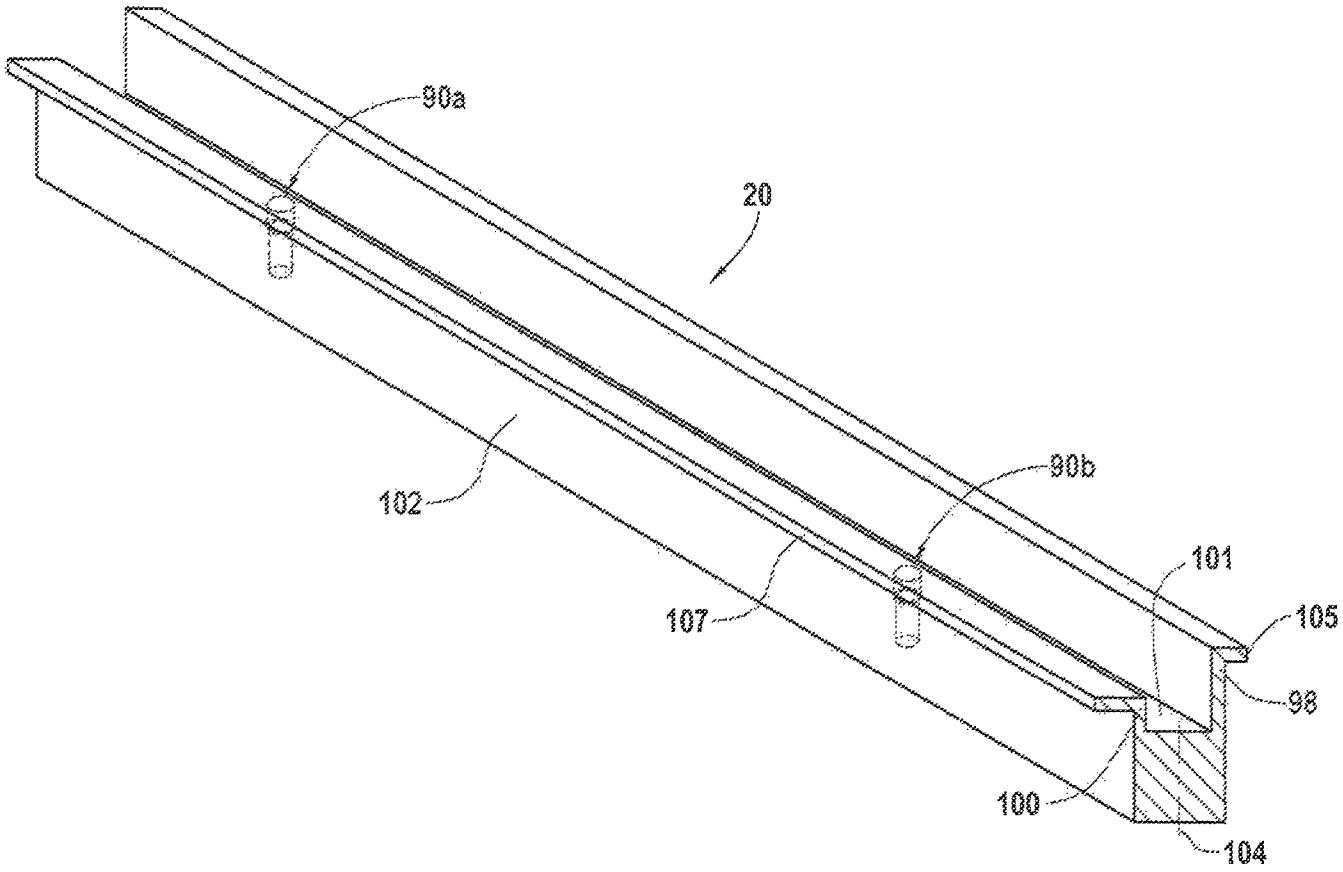
FIG. 4 depicts a perspective view of the dual support connector assembly according to one or more embodiments.

FIG. 4 depicts a perspective view of the dual support connector assembly 20 according to one or more embodiments.

The dual support connector assembly 20 includes a clip body 102. A door flange 98 extends from the clip body 102.

The clip body 102 has a pair of through holes 90*a* and 90*b*.

In embodiments, the door flange 98 includes a door flange lip 105 extending at an angle from 80 degrees to 100 degrees from a central axis 104 of the clip body 102.

A glass flange 100 extends from the clip body 102 in parallel with the door flange 98.

In embodiments, the glass flange 100 includes a glass flange lip 107 extending at an angle from 80 degrees to 100 degrees from a central axis 104 of the clip body 102.

In embodiments, the height of the door flange 98 and the height of the glass flange 100 are unequal.

Figure 5:
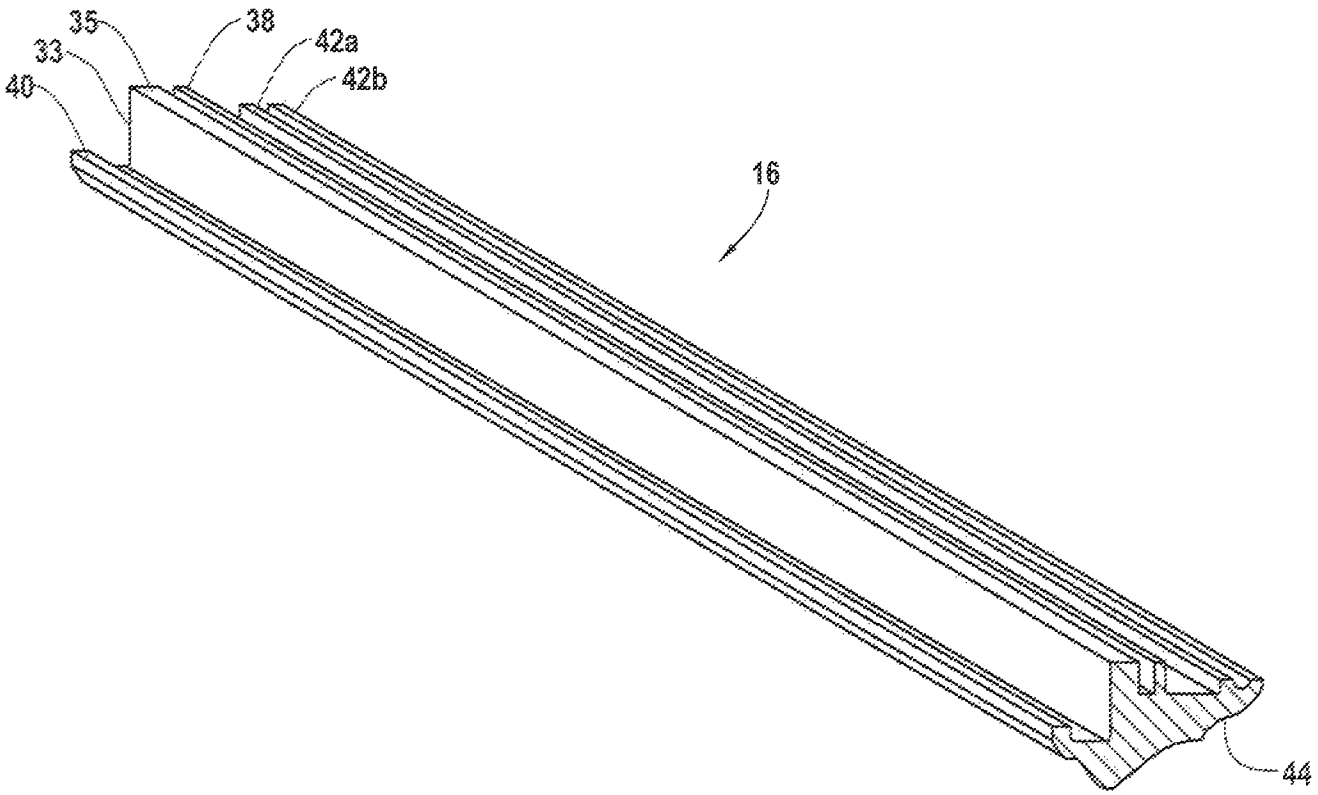
FIG. 5 depicts a perspective view of the fixed sealing frame according to one or more embodiments.

FIG. 5 depicts a perspective view of the fixed sealing frame 18 according to one or more embodiments.

The fixed sealing frame 18 has a door contact surface 40 extending from the fixed sealing frame profile 44.

A lower flex and sealing gap surface 35 extends from the side flex and sealing gap surface 33.

In embodiments, the fixed sealing frame 18 has a second channel engagement member 38 parallel to the lower flex and sealing gap surface 35.

The second channel engagement member 38 is parallel to a first glass contact surface 42*a* and a second glass contact surface 42*b*.

Figure 6:
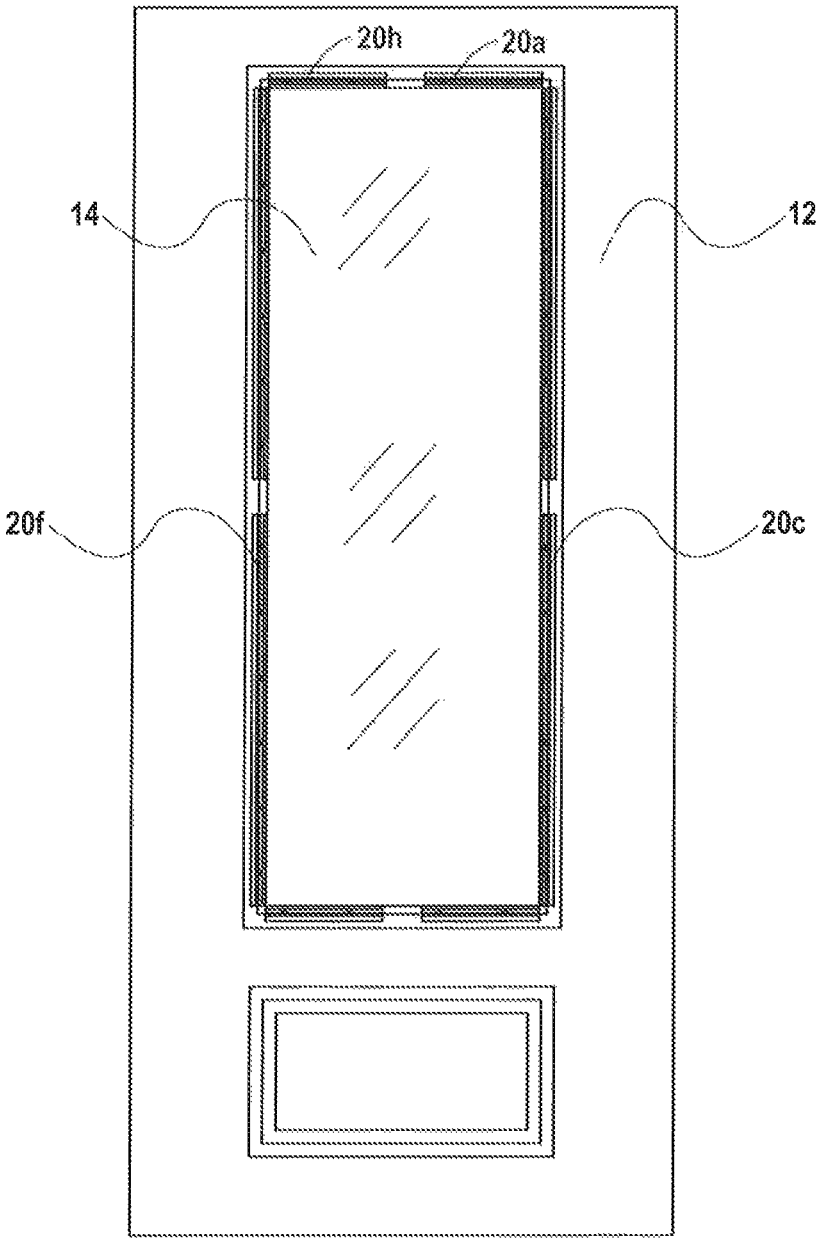
FIG. 6 is a front view of the connectors mounted in the fixed sealing frame.

FIG. 6 depicts a front view of a door panel 12 with dual support connector assembly and according to one or more embodiments.

The door is shown with a door panel 12, a glass panel 14, and dual support connector assembly 20*a*-20*h* positioned between the door panel 12 and glass panel 14.

Figure 7:
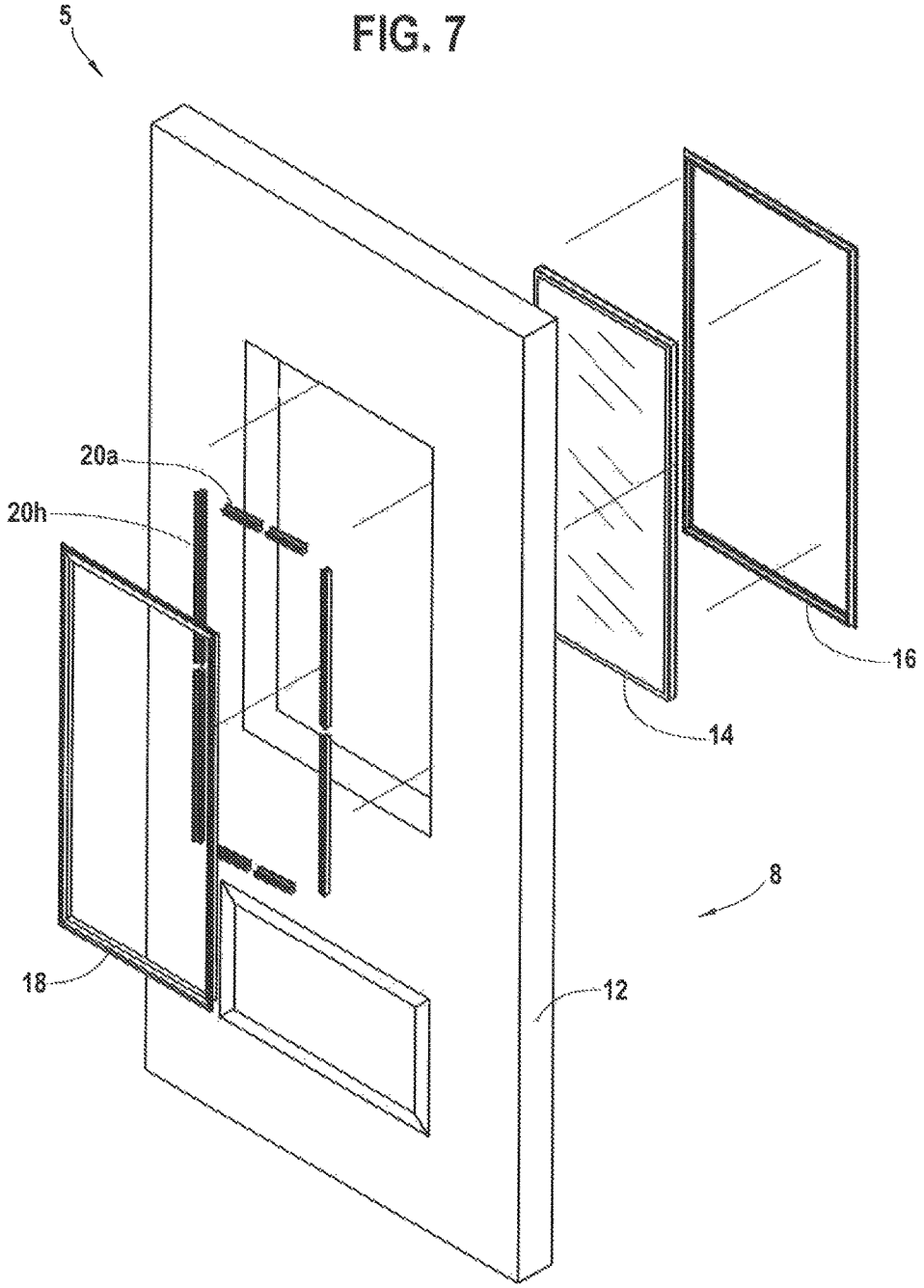
FIG. 7 is an exploded view of the assembly.

FIG. 7 depict and exploded view of a door panel 12 with dual support connector assembly without corner clips according to one or more embodiments.

The door is shown with a door panel 12, a glass panel 14, and dual support connector assembly 20*a*-20*h* positioned between the door panel 12 and glass panel 14.

A fixed sealing frame 18 is shown with a fasteners 22*a*-22*r* for engaging the fixed sealing frame 18 to the dual support connector assembly 20*a*-20*h*.

A seal-less removable frame 16 attaches to the dual support connector assembly 20*a*-20*h* on an opposite side of the door panel 12 and glass panel 14 from the fixed sealing frame 18.

While these embodiments have been described with emphasis on the embodiments, it should be understood that within the scope of the appended claims, the embodiments might be practiced other than as specifically described herein.

What is claimed is:

1. An improved door with a dual support connector assembly and without corner clips comprising:

a. a door panel;

b. a glass panel;

c. a dual support connector assembly positioned between the door panel and glass panel simultaneously, the dual support connector assembly comprising:

(i) a clip body having a pair of through holes;

(ii) a door flange extending from the clip body; and (iii) a glass flange extending from the clip body in parallel with the door flange;

d. a fixed sealing frame for engaging the dual support connector assembly;

e. a first seal between the door panel and the fixed sealing frame for sealing the fixed sealing frame to the door panel;

f. a second seal between the glass panel and the fixed sealing frame for sealing the fixed sealing frame to the glass panel;

g. a seal-less removable frame with a seal-less removable frame profile for attaching to the dual support connector assembly;

h. a fastener engaging the clip body to the fixed sealing frame;

i. a plurality of compression brads, each compression brad penetrating the seal-less removable frame and the clip body without penetrating the door panel or the glass panel, each compression brad penetrating the clip body at an angle between 10 and 90 degrees, in a spaced apart relationship;

wherein the door assembly with the improved dual support connector assembly without corner clips is secured between the fixed sealing frame, the door panel, the glass panel, and the seal-less removable frame opposite side of the fixed sealing frame without touching the seal-less removable frame creating an easily removable glass panel with a secure connection, which prevents a door or glass pane from breaking during severe weather, including a hurricane.

2. The improved door assembly with the dual support connector assembly without corner clips of claim 1, wherein the fixed sealing frame comprises:

a. a fixed sealing frame profile;

b. a door contact surface extending from the fixed sealing frame profile;

c. a side flex and sealing gap surface extending from the door contact surface forming an upper flex and sealing gap between the door contact surface and the side flex and sealing gap surface;

d. a lower flex and sealing gap surface extending from the side flex and sealing gap surface forming a first channel engagement member;

e. a second channel engagement member formed in parallel to the first channel engagement member creating an first alignment cavity;

f. a flex gap formed between the second channel engagement member and a first glass contact surface; and g. a second glass contact surface formed in parallel to the first glass contact surface containing the first seal and extending to the fixed sealing frame profile.

3. The improved door assembly with the dual support connector assembly without corner clips of claim 1, comprising a textured surface, a smooth surface or a woodgrain surface formed on at least one: the fixed sealing frame profile and the seal-less removable frame profile.

4. The improved door assembly with dual support connector assembly without corner clips of claim 1, comprising a shape for the fixed sealing frame profile and the seal-less removable frame profile are selected from the group: rectangle, rectangle with rounded edges, a half round, or a decorative molding shape.

5. The improved door assembly with the dual support connector assembly without corner clips of claim 1, comprising a coating layer on the fixed sealing frame profile wherein the coating layer consists of a stain, a paint, a sealant or a primer.

6. The improved door assembly with the dual support connector assembly without corner clips of claim 1, wherein the door flange comprises a door flange lip extending at an angle from 80 degrees to 100 degrees from a central axis of the clip body.

7. The improved door assembly with the dual support connector assembly without corner clips of claim 1, wherein the glass flange comprises a glass flange lip extending at an angle from 80 degrees to 100 degrees from the central axis of the clip body.

8. The improved door assembly with the dual support connector assembly without corner clips of claim 1, wherein the glass panel comprises a plurality of glass panes.

9. The improved door assembly with the dual support connector assembly without corner clips of claim 1, comprising glass panes separated by a spacer/sealant.

10. The improved door assembly with the dual support connector assembly without corner clips of claim 1, wherein the height of the door flange and the height of the glass flange are unequal.

11. The improved door assembly with the dual support connector assembly without corner clips of claim 1, wherein the seal-less removable frame comprises:

a. a seal-less removable frame profile with a coating layer;

b. a door contact surface extending from the seal-less removable frame profile;

c. a first side gap surface extending from the door contact surface;

d. a second side gap surface extending from the first side gap surface forming a rigid gap;

e. a first alignment channel member;

f. a first clip surface formed on the first alignment channel member;

g. a second alignment channel member in parallel with the first alignment channel member creating a second alignment cavity;

h. a second clip surface formed on the second alignment channel member;

i. a third side gap surface extending from the second clip surface;

j. a rigid gap formed between the second alignment channel member and a fourth side gap surface;

k. a first glass contact surface; and l. a second glass contact surface formed in parallel to the first glass contact surface with the second glass contact surface extending to the seal-less removable frame profile.

12. The improved door assembly with the dual support connector assembly without corner clips of claim 11, wherein the coating layer consists of a stain, a paint, a sealant, and a primer.

* * * * *